US009969144B1

(12) United States Patent
Awano

(10) Patent No.: US 9,969,144 B1
(45) Date of Patent: May 15, 2018

(54) POST-PROCESSING DEVICE AND IMAGE FORMING APPARATUS

(71) Applicant: FUJI XEROX CO., LTD., Tokyo (JP)

(72) Inventor: Hiroaki Awano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/681,794

(22) Filed: Aug. 21, 2017

(30) Foreign Application Priority Data

Mar. 29, 2017 (JP) ..... 2017-065182

(51) Int. Cl.
*B31F 5/02* (2006.01)
*B42C 1/12* (2006.01)
(Continued)

(52) U.S. Cl.
CPC ..... *B31F 5/02* (2013.01); *B31F 1/07* (2013.01); *B42C 1/12* (2013.01); *B42C 1/125* (2013.01); *B65H 37/04* (2013.01); *G03G 15/6541* (2013.01); *G03G 15/6544* (2013.01); *B31F 2201/0712* (2013.01); *B65H 2301/421* (2013.01); *B65H 2301/43828* (2013.01); *B65H 2301/51616* (2013.01); *B65H 2405/114* (2013.01); *B65H 2408/122* (2013.01); *B65H 2408/1222* (2013.01); *B65H 2801/27* (2013.01);
(Continued)

(58) Field of Classification Search
CPC ... B42C 1/12; B42C 1/125; B31F 1/07; B31F 5/02; B31F 2201/0712; B65H 37/04; B65H 2301/51616; B65H 2301/53828; B65H 2301/421; B65H 2408/122; B65H 2408/1222; B65H 2405/114; B65H 2801/27; G03G 15/6544; G03G 15/6541; G03G 2215/00827; G03G 2215/00852
USPC ..... 270/58.08
See application file for complete search history.

(56) References Cited

U.S. PATENT DOCUMENTS 8,235,375 B2 * 8/2012 Shiraishi ..... B65H 31/02 270/58.08
8,262,075 B2 * 9/2012 Shiraishi ..... B31F 5/027 270/58.08
(Continued)

FOREIGN PATENT DOCUMENTS

JP 2003-089462 A 3/2003
JP 2003-089463 A 3/2003
(Continued)

*Primary Examiner* — Leslie A Nicholson, III
(74) *Attorney, Agent, or Firm* — Oliff PLC

(57) ABSTRACT

A post-processing device includes a stacking portion on which media are stacked; a staple binding device that binds the media together by using a staple and that is movable between staple binding positions at which the staple binding device binds the media together and a supply position that is in a front section in a width direction of the media and at which staples are suppliable to the staple binding device; and a stapleless binding device that binds the media together without using a staple and that is movable between a stapleless binding position at which the stapleless binding device binds the media together and a retracted position that is in the front section. When the stapleless binding device is moved to the retracted position, the staple binding device and the stapleless binding device do not interfere with each other irrespective of a position of the staple binding device.

11 Claims, 9 Drawing Sheets

(51) Int. Cl.
*G03G 15/00* (2006.01)
*B65H 37/04* (2006.01)
*B31F 1/07* (2006.01)

(52) U.S. Cl.
CPC ..... *G03G 2215/00827* (2013.01); *G03G 2215/00852* (2013.01)

(56) References Cited

U.S. PATENT DOCUMENTS

| | | | | |
|---|---|---|---|---|
| 8,297,610 | B2 * | 10/2012 | Shiraishi | B65H 37/04 270/58.08 |
| 8,540,228 | B2 * | 9/2013 | Shiraishi | B42C 1/12 270/58.07 |
| 9,221,291 | B2 | 12/2015 | Kubo et al. | |
| 9,567,184 | B2 * | 2/2017 | Kanemaru | B65H 31/02 |
| 9,725,275 | B2 * | 8/2017 | Matsuki | B65H 37/04 |
| 9,725,276 | B2 * | 8/2017 | Takahashi | B65H 31/26 |
| 2016/0165091 | A1 * | 6/2016 | Ooba | H04N 1/32561 358/1.15 |
| 2016/0340144 | A1 | 11/2016 | Sakano et al. | |
| 2016/0360053 | A1 * | 12/2016 | Suzuki | B65H 33/00 |
| 2017/0217239 | A1 * | 8/2017 | Suzuki | B42C 1/12 |

FOREIGN PATENT DOCUMENTS

| | | | |
|---|---|---|---|
| JP | 2006-069746 | A | 3/2006 |
| JP | 2006-069749 | A | 3/2006 |
| JP | 2015-030592 | A | 2/2015 |
| JP | 2016-216216 | A | 12/2016 |

* cited by examiner

POST-PROCESSING DEVICE AND IMAGE FORMING APPARATUS

CROSS-REFERENCE TO RELATED APPLICATIONS

This application is based on and claims priority under 35 USC 119 from Japanese Patent Application No. 2017-065182 filed Mar. 29, 2017.

BACKGROUND

Technical Field

The present invention relates to a post-processing device and an image forming apparatus.

SUMMARY

According to an aspect of the invention, there is provided a post-processing device including a stacking portion on which media having images recorded thereon are stacked; a staple binding device that binds the media stacked on the stacking portion together by using a staple and that is movable between plural staple binding positions at which the staple binding device binds the media together and a supply position that is in a front section in a width direction of the media and at which staples are suppliable to the staple binding device; and a stapleless binding device that binds the media stacked on the stacking portion together without using a staple and that is movable between a stapleless binding position at which the stapleless binding device binds the media together and a retracted position that is in the front section in the width direction of the media. When the stapleless binding device is moved to the retracted position, the staple binding device and the stapleless binding device do not interfere with each other irrespective of a position of the staple binding device.

BRIEF DESCRIPTION OF THE DRAWINGS

Exemplary embodiments of the present invention will be described in detail based on the following figures, wherein:

FIG. 8B is a perspective view of the stapleless stapler at the retracted position, and FIG. 8C is a perspective view of the stapleless stapler at the stapleless binding position.

DETAILED DESCRIPTION

Exemplary embodiments of the present invention will now be described with reference to the drawings. However, the present invention is not limited to the following exemplary embodiments.

To facilitate understanding of the following description, in each figure, the front-back direction, the left-right direction, and the up-down direction are defined as the X-axis direction, the Y-axis direction, and the Z-axis direction, respectively. In addition, the directions shown by arrows X, −X, Y, −Y, Z, and −Z are defined as forward, backward, rightward, leftward, upward, and downward, respectively, and sides in those directions are defined as the front side, the back side, the right side, the left side, the top side, and the bottom side, respectively.

In the figures, circles having dots at the center show the direction from the far side to the near side of each figure, and circles having the "x" marks therein show the direction from the near side to the far side of each figure.

In each figure, components other than those necessary for explanation are omitted to facilitate understanding.

First Exemplary Embodiment

Overall Structure of Copy Machine U of First Exemplary Embodiment

Figure 1:
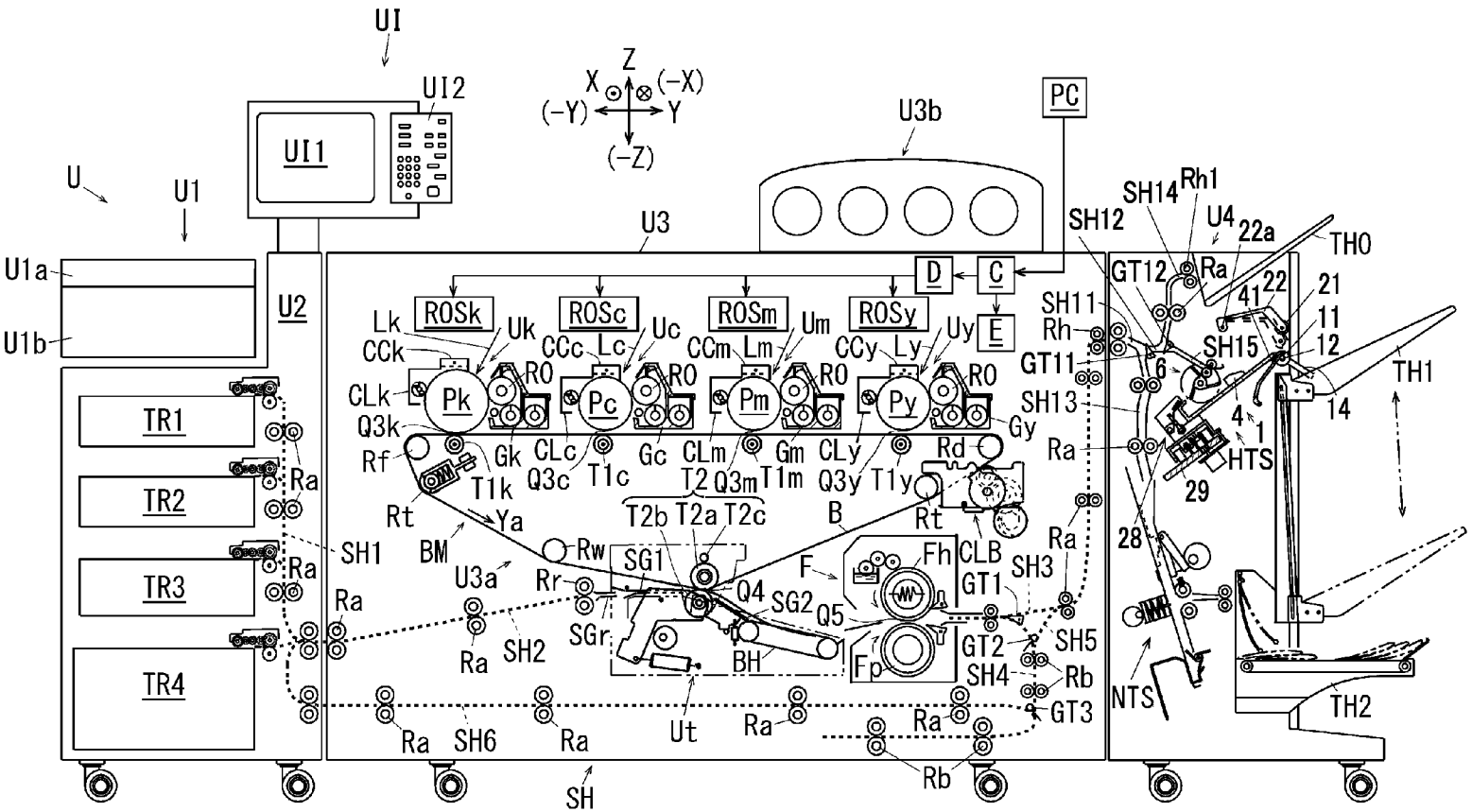
FIG. 1 illustrates the overall structure of an image forming apparatus according to a first exemplary embodiment of the present invention.

FIG. 1 illustrates the overall structure of an image forming apparatus according to a first exemplary embodiment of the present invention.

In FIG. 1, a copy machine U, which is an example of an image forming apparatus according to the first exemplary embodiment, includes a scanner unit U1 as an example of an image-information reading device. A sheet feeding device U2, which is an example of a medium supplying device, is disposed below the scanner unit U1. A printer unit U3, which is an example of an image forming apparatus body, is disposed on the right side of the sheet feeding device U2. A finisher U4, which is an example of a post-processing device, is disposed on the right side of the printer unit U3. A user interface UI, which is an example of an operation unit, is supported above the sheet feeding device U2.

The user interface UI includes a display panel UI1 as an example of a display, and an input button unit UI2 as an example of an input unit. The input button unit UI2 includes a copy start key, numeric keys, and a copy-number input key.

The scanner unit U1 includes a document feeder U1*a* as an example of a document transporting device, and an image scanner U1*b* as an example of an image reading unit.

The sheet feeding device U2 includes plural sheet feeding trays TR1 to TR4 as examples of medium containers. Each of the sheet feeding trays TR1 to TR4 contains sheets S as examples of media. A supply path SH1, which is an example of a transport path, is provided in the sheet feeding device U2. The supply path SH1 connects the sheet feeding trays TR1 to TR4 to the printer unit U3.

Structure of Image Recording Unit U3*a* of First Exemplary Embodiment

In FIG. 1, the printer unit U3 includes an image recording unit U3*a* that records an image on a sheet S. A toner dispenser U3*b*, which is an example of a developer supplying device, is disposed above the image recording unit U3*a*.

The printer unit U3 includes a controller C as an example of a control unit. The controller C is electrically connected to a client personal computer PC, which is an example of an image information transmitter. The controller C receives image information or the like transmitted from the client personal computer PC. The controller C controls a laser drive circuit D, which is an example of an exposure-device drive circuit, and a power supply circuit E.

The laser drive circuit D outputs signals corresponding to image information for respective colors, which are yellow (Y), magenta (M), cyan (C), and black (K), to exposure devices ROSy, ROSm, ROSc, and ROSk for the respective colors Y, M, C, and K on the basis of the information input from the scanner unit U1 or the client personal computer PC at a preset timing.

Photoconductors Py, Pm, Pc, and Pk, which are examples of image carriers, are disposed below the respective exposure devices ROSy, ROSm, ROSc, and ROSk. In the first exemplary embodiment, the black (K) photoconductor Pk, which is frequently used and whose surface easily wears, has a diameter greater than those of the photoconductors Py, Pm, and Pc for the other colors Y, M, and C. Accordingly, the black (K) photoconductor Pk enables high-speed rotation, and has a long lifespan.

A charger CCk, which is an example of a charging device, is disposed above the black (K) photoconductor Pk. A developing device Gk is disposed downstream of the charger CCk in a rotation direction in which the photoconductor Pk rotates. The developing device Gk includes a developing roller RO as an example of a developer carrier. A first transfer roller T1*k*, which is an example of a first transfer device, is disposed downstream of the developing device Gk in the rotation direction of the photoconductor Pk. A cleaner CLk, which is an example of a photoconductor cleaning device, is disposed downstream of the first transfer roller T1*k* in the rotation direction of the photoconductor Pk.

The photoconductor Pk, the charger CCk, and the cleaner CLk form a black (K) photoconductor unit Uk as an example of an image carrier unit according to the first exemplary embodiment. Therefore, the photoconductor Pk, the charger CCk, and the cleaner CLk are formed integrally with each other and are detachably attached to the printer unit U3. Similarly to the black (K) photoconductor unit Uk, photoconductor units Uy, Um, and Uc for the other colors (Y, M, and C) respectively include photoconductors Py, Pm, and Pc, chargers CCy, CCm, and CCc, and cleaners CLy, CLm, and CLc.

The photoconductor units Uy, Um, Uc, and Uk and the developing devices Gy, Gm, Gc, and Gk constitute visible-image forming members Uy+Gy, Um+Gm, Uc+Gc, and Uk+Gk according to the first exemplary embodiment.

A belt module BM, which is an example of an intermediate transfer device, is disposed below the visible-image forming members Uy+Gy, Um+Gm, Uc+Gc, and Uk+Gk.

The belt module BM includes an intermediate transfer belt B, belt support rollers Rd, Rt, Rw, Rf, and T2*a*, which are examples of intermediate-transfer-body support members, and first transfer rollers T1*y*, T1*m*, T1*c*, and T1*k*. The belt support rollers Rd, Rt, Rw, Rf, and T2*a* include a belt driving roller Rd, which is an example of an intermediate-transfer-body driving member; a tension roller Rt, which is an example of a tension applying member; a walking roller Rw, which is an example of a meandering preventing member; plural idler rollers Rf, which are examples of driven members; and a backup roller T2*a*, which is an example of an opposing member for a second transfer process. The intermediate transfer belt B is supported by the belt support rollers Rd, Rt, Rw, Rf, and T2*a* such that the intermediate transfer belt B is rotatable in the direction of arrow Ya.

A belt cleaner CLB, which is an example of an intermediate-transfer-body cleaning device, is disposed near the belt driving roller Rd.

A second transfer unit Ut is disposed below the backup roller T2*a*. The second transfer unit Ut includes a second transfer roller T2*b* as an example of a second transfer member. The region in which the second transfer roller T2*b* is in contact with the intermediate transfer belt B serves as a second transfer region Q4, which is an example of an image recording region. A contact roller T2*c*, which is an example of a voltage-applying contact member, is in contact with the backup roller T2*a*. A second transfer voltage having the same polarity as the charging polarity of the toner is applied to the contact roller T2*c* by the power supply circuit E, controlled by the controller C, at a preset timing.

The backup roller T2*a*, the second transfer roller T2*b*, and the contact roller T2*c* form a second transfer device T2 according to the first exemplary embodiment. The first transfer rollers T1*y*, T1*m*, T1*c*, and T1*k*, the intermediate transfer belt B, and the second transfer device T2 constitute a transferring device T1+B+T2 according to the first exemplary embodiment which transfers the images on the surfaces of the photoconductors Py to Pk onto the sheet S.

A feeding path SH2, which is another example of a transport path, is disposed below the belt module BM. The feeding path SH2 extends from the supply path SH1 of the sheet feeding device U2 toward the second transfer region Q4. Plural transport rollers Ra, which are examples of medium transporting members, are arranged along the feeding path SH2. In addition, a registration roller Rr is provided on the feeding path SH2 at a location upstream of the second transfer region Q4 in the transporting direction of the sheet S. The registration roller Rr is an example of an adjusting member that adjusts a transport timing at which the sheet S is transported to the second transfer device T2. A medium guiding member SGr for guiding the medium is disposed downstream of the registration roller Rr in the transporting direction of the sheet S. The medium guiding member SGr is fixed to the printer unit U3 together with the registration roller Rr. A medium guiding member SG1 for guiding the medium before the transfer process is disposed between the medium guiding member SGr and the second transfer region Q4.

A medium guiding member SG2 for guiding the medium after the transfer process is disposed downstream of the second transfer region Q4 in the transporting direction of the sheet S. A transporting belt BH, which is an example of a medium transporting member, is disposed downstream of the medium guiding member SG2, which guides the medium after the transfer process, in the transporting direction of the sheet S. A fixing device F is disposed downstream of the transporting belt BH in the transporting direction of the sheet S. The fixing device F includes a heating roller Fh, which is an example of a heating fixing member, and a pressing roller Fp, which is an example of a pressing fixing member. The region in which the heating roller Fh and the pressing roller Fp are in contact with each other serves as a fixing region Q5.

The visible-image forming members Uy+Gy to Uk+Gk, the transferring device T1+B+T2, and the fixing device F constitute the image recording unit U3*a* according to the first exemplary embodiment.

An ejection path SH3, which is another example of a transport path, is disposed downstream of the fixing device F in the transporting direction of the sheet S. The ejection path SH3 extends rightward and upward from the downstream end of the feeding path SH2 in the transporting direction of the sheet S. The transport rollers Ra are arranged along the ejection path SH3. An ejection roller Rh, which is an example of a medium ejecting member, is disposed at the downstream end of the ejection path SH3 in the transporting direction of the sheet S.

An upstream end of a reversing path SH4, which is also an example of a transport path, in the transporting direction of the sheet S is connected to a connecting portion between the feeding path SH2 and the ejection path SH3. The reversing path SH4 extends downward. Reversing rollers Rb, which are examples of medium reversing members and which are rotatable in forward and reverse directions, are arranged along the reversing path SH4. An upstream end of an ejecting-reversing path SH5, which is also an example of a transport path, in the transporting direction of the sheet S is connected to the reversing path SH4 at an intermediate position thereof. The downstream end of the ejecting-reversing path SH5 in the transporting direction of the sheet S is connected to the ejection path SH3. An upstream end of a circulation path SH6, which is also an example of a transport path, in the transporting direction of the sheet S is connected to the reversing path SH4 at an intermediate position thereof that is downstream of the position at which the reversing path SH4 is connected to the ejecting-reversing path SH5 in the transporting direction of the sheet S. The circulation path SH6 connects the reversing path SH4 to the supply path SH1 of the sheet feeding device U2. Transport rollers Ra are arranged along the circulation path SH6.

A switching gate GT1, which is an example of a destination switching member, is provided on a connecting portion between the feeding path SH2 and the ejection path SH3.

A Mylar gate GT2, which is an example of a transporting-direction regulating member, is provided on a connecting portion between the reversing path SH4 and the ejecting-reversing path SH5.

A Mylar gate GT3, which is also an example of a transporting-direction regulating member, is provided on a connecting portion between the reversing path SH4 and the circulation path SH6.

Elements denoted by SH1 to SH6 constitute a transporting path body SH according to the first exemplary embodiment.

Operation of Image Recording Unit U3*a* of First Exemplary Embodiment

When the controller C receives image information from the client personal computer PC or the scanner unit U1, the copy machine U starts a job, that is, an image forming operation. When the job is started, the photoconductors Py to Pk, the intermediate transfer belt B, and other components start to rotate.

The chargers CCy to CCk receive a preset voltage from the power supply circuit E, and charge the surfaces of the photoconductors Py to Pk.

The exposure devices ROSy to ROSk output laser beams Ly, Lm, Lc, and Lk, which are examples of latent-image-writing light, on the basis of signals from the laser drive circuit D. The surfaces of the photoconductors Py to Pk are irradiated with the laser beams Ly to Lk so that electrostatic latent images are formed thereon.

The developing rollers RO of the developing devices Gy to Gk develop the electrostatic latent images on the surfaces of the photoconductors Py to Pk into visible images.

The toner dispenser U3*b* supplies developers to the developing devices Gy to Gk when the developers in the developing devices Gy to Gk are consumed.

The power supply circuit E applies a first transfer voltage to the first transfer rollers T1*y* to T1*k*, the first transfer voltage having a polarity opposite to the charging polarity of the developers. Thus, the visible images on the surfaces of the photoconductors Py to Pk are transferred onto the surface of the intermediate transfer belt B.

The cleaners CLy to CLk clean the surfaces of the photoconductors Py to Pk by removing the developers that remain thereon after the first transfer process.

Y, M, C, and K images are transferred onto the intermediate transfer belt B in that order in a superimposed manner when the intermediate transfer belt B passes through the first transfer regions Q3*y* to Q3*k* that face the photoconductors Py to Pk, respectively. Then, the intermediate transfer belt B passes through the second transfer region Q4 that faces the second transfer device T2. When a monochrome image is to be formed, a single colored image is transferred onto the intermediate transfer belt B, and then the intermediate transfer belt B passes through the second transfer region Q4.

The sheet feeding trays TR1 to TR4 contain sheets S. A sheet S contained in one of the sheet feeding trays TR1 to TR4 is transported along the supply path SH1 of the sheet feeding device U2 by the transport rollers Ra, and fed to the feeding path SH2 of the printer unit U3.

The sheet S fed to the feeding path SH2 is transported toward the registration roller Rr.

The registration roller Rr feeds the sheet S toward the second transfer region Q4 at the time when the image on the surface of the intermediate transfer belt B is transported to the second transfer region Q4.

In the second transfer device T2, the power supply circuit E applies a second transfer voltage to the backup roller T2*a* through the contact roller T2*c*. The second transfer voltage has the same polarity as the preset charging polarity of the developers. Therefore, the image on the intermediate transfer belt B is transferred onto the sheet S that passes through the second transfer region Q4.

The belt cleaner CLB cleans the surface of the intermediate transfer belt B by removing the developers that remain thereon after the image has been transferred in the second transfer region Q4.

The transporting belt BH holds the sheet S, onto which the image has been transferred by the second transfer device T2, on the surface thereof and transports the sheet S to the fixing device F.

The fixing device F heats the sheet S that passes through the fixing region Q5 while applying a pressure to the sheet S. Accordingly, the unfixed image on the surface of the sheet S is fixed to the sheet S. The sheet S to which the image has been fixed is transported to the downstream end of the feeding path SH2 in the transporting direction of the sheet S.

The switching gate GT1 at the downstream end of the feeding path SH2 in the transporting direction of the sheet S switches the destination of the sheet S between the ejection path SH3 and the reversing path SH4.

When the sheet S is to be ejected in a reversed manner or when double-sided printing is to be performed, the destination of the sheet S having an image recorded on one side thereof is switched to the reversing path SH4. Accordingly, the sheet S is transported to the reversing path SH4. The sheet S is transported along the reversing path SH4 by the reversing rollers Rb and passes through the Mylar gate GT2.

When the sheet S is to be ejected in a reversed state, the reversing rollers Rb start to rotate in the reverse direction after the upstream end of the sheet S in the transporting direction of the sheet S has passed the Mylar gate GT2. Accordingly, the sheet S is transported in the reverse direction in a so-called switchback manner. When double-sided printing is to be performed, the reversing rollers Rb start to rotate in the reverse direction after the upstream end of the sheet S in the transporting direction of the sheet S has passed the Mylar gate GT2 and the Mylar gate GT3, so that the sheet S is transported in the switchback manner.

The Mylar gate GT2 first allows the sheet S that has been transported along the reversing path SH4 to pass therethrough. Then, the Mylar gate GT2 regulates the transporting direction of the sheet S transported in a switchback manner so as to guide the sheet S to the ejecting-reversing path SH5. Accordingly, the sheet S is guided from the ejecting-reversing path SH5 to the ejection path SH3.

The Mylar gate GT3 first allows the sheet S that has been transported along the reversing path SH4 to pass therethrough. Then, the Mylar gate GT3 regulates the transporting direction of the sheet S transported in a switchback manner to guide the sheet S to the circulation path SH6.

The sheet S that has been transported to the circulation path SH6 is transported to the supply path SH1 in the sheet feeding device U2. Thus, the sheet S transported in the switchback manner is transported from the supply path SH1 to the registration roller Rr on the feeding path SH2 again in a reversed state. Accordingly, an image is recorded on a second side of the sheet S.

When the sheet S on which an image is recorded is to be ejected from the printer unit U3, the destination of the sheet S is switched to the ejection path SH3. Accordingly, the sheet S having the image recorded thereon is guided to the ejection path SH3. The sheet S is transported along the ejection path SH3 by the transport rollers Ra, and ejected from the printer unit U3 by the ejection roller Rh.

Structure of Finisher U4 of First Exemplary Embodiment

Figure 2:
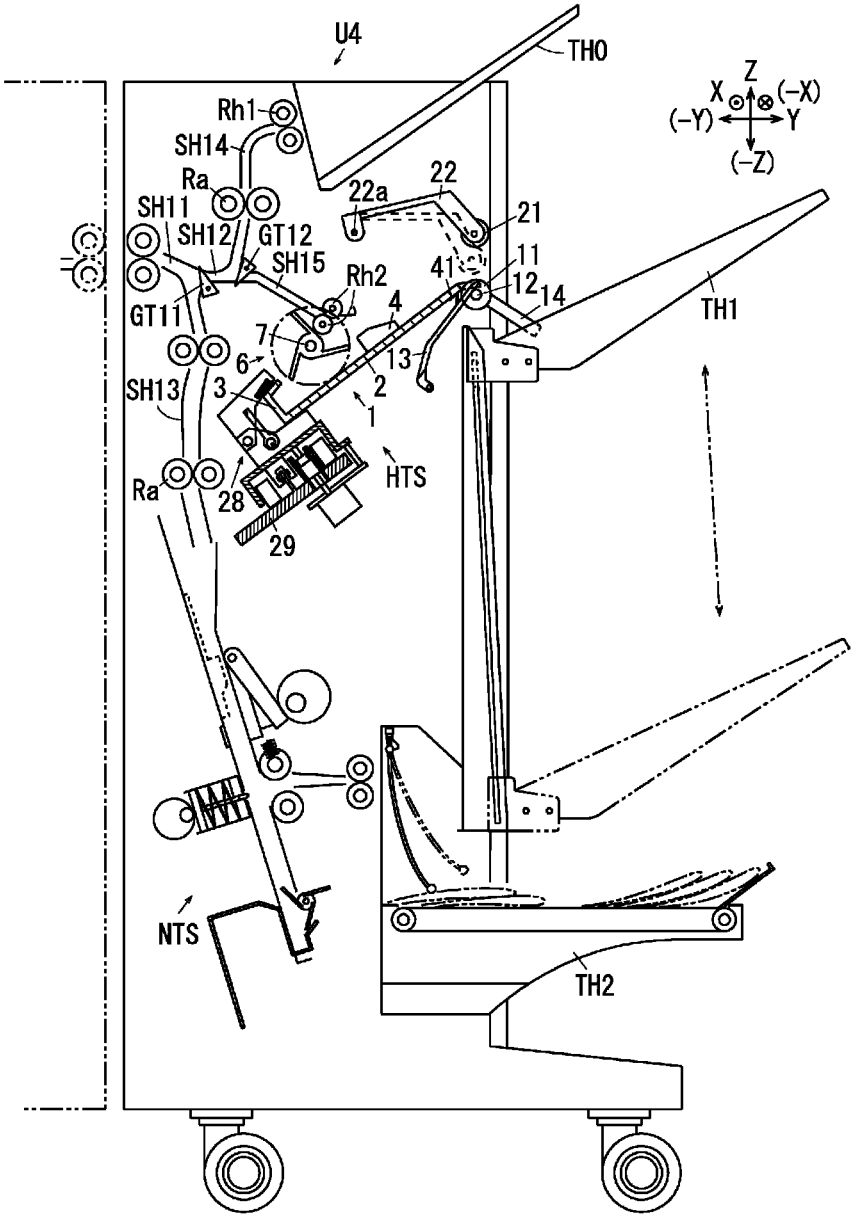
FIG. 2 illustrates a post-processing device according to the first exemplary embodiment of the present invention.

FIG. 2 illustrates a post-processing device according to the first exemplary embodiment of the present invention.

In FIGS. 1 and 2, the finisher U4, which is an example of a post-processing device, is disposed on the right side of the printer unit U3. The finisher U4 includes a feeding path SH11, which is another example of a transport path. The feeding path SH11 extends into the finisher U4 from the downstream end of the ejection path SH3 of the printer unit U3 in the transporting direction of the sheet S. An upstream end of a relay path SH12, which is also an example of a transport path and which extends rightward, in the transporting direction of the sheet S is connected to the downstream end of the feeding path SH11 in the transporting direction of the sheet S. An upstream end of a saddle-stitching transport path SH13, which is also an example of a transport path and which extends downward, in the transporting direction of the sheet S is also connected to the downstream end of the feeding path SH11 in the transporting direction of the sheet S.

An upstream end of an ejection path SH14, which is also an example of a transport path and which extends upward, in the transporting direction of the sheet S is connected to the downstream end of the relay path SH12 in the transporting direction of the sheet S. An upstream end of an edge-binding transport path SH15, which is also an example of a transport path and which extends rightward, in the transporting direction of the sheet S is connected to the downstream end of the relay path SH12 in the transporting direction of the sheet S.

A first gate GT11, which is an example of a destination switching member, is provided at a branching portion between the relay path SH12 and the saddle-stitching transport path SH13.

A second gate GT12, which is also an example of a destination switching member, is provided at a branching portion between the ejection path SH14 and the edge-binding transport path SH15.

An ejection roller Rh1, which is an example of an ejecting member, is arranged at the downstream end of the ejection path SH14 in the transporting direction of the sheet S. A top tray TH0, which is an example of a medium receiver, is supported at a location downstream of the ejection roller Rh1 in an ejecting direction in which the sheet S is ejected.

An edge binding device HTS is disposed downstream of the edge-binding transport path SH15 in the transporting direction of the sheet S. A stacker tray TH1, which is an example of an edge-binding receiver, is supported at a location downstream of the edge binding device HTS in the transporting direction of the sheet S. The stacker tray TH1 is supported in a vertically movable manner.

A saddle stitching device NTS is disposed downstream of the saddle-stitching transport path SH13 in the transporting direction of the sheet S. A saddle-stitching stacker tray TH2, which is an example of a saddle-stitching receiver, is supported at a location downstream of the saddle stitching device NTS in the transporting direction of the sheet S. The saddle stitching device NTS may have a well-known structure as those described in, for example, Japanese Unexamined Patent Application Publication Nos. 2003-089462, 2003-089463, 2006-69746, or 2006-69749, and detailed description of the saddle stitching device NTS is thus omitted.

Operation of Finisher U4 of First Exemplary Embodiment

The sheet S transported from the printer unit U3 is fed to the feeding path SH11 of the finisher U4. The sheet S fed to the feeding path SH11 is transported to the first gate GT11.

The first gate GT11 switches the destination of the sheet S between the relay path SH12 and the saddle-stitching transport path SH13 depending on the settings regarding post-processing.

The sheet S fed to the relay path SH12 is transported to the second gate GT12.

The second gate GT12 switches the destination of the sheet S between the ejection path SH14 and the edge-binding transport path SH15 depending on the settings regarding post-processing.

The sheet S fed to the ejection path SH14 is ejected to the top tray TH0 by the ejection roller Rh1.

The sheet S fed to the edge-binding transport path SH15 is transported to the edge binding device HTS.

The edge binding device HTS aligns the edges of plural sheets S and binds the edges of the sheets S together. The stack of sheets S processed by the edge binding device HTS is ejected to the stacker tray TH1.

When the stack of sheets S is placed on the stacker tray TH1, the stacker tray TH1 moves downward depending on the number of sheets S placed thereon.

The sheet S fed to the saddle-stitching transport path SH13 is transported to the saddle stitching device NTS.

The saddle stitching device NTS processes a stack of sheets S so as to bind the sheets S together at the center thereof in the transporting direction of the sheets S. The saddle stitching device NTS folds the stack of bound sheets S in half at the center and ejects the folded stack of sheets S to the saddle-stitching stacker tray TH2.

Edge Binding Device HTS of First Exemplary Embodiment

Referring to FIG. 2, the edge binding device HTS according to the first exemplary embodiment includes a compiler tray 1 as an example of a stacking portion. The compiler tray 1 includes a tray body 2 as an example of a stacking-portion body. The tray body 2 has the shape of a plate that extends from the lower left toward the upper right, that is, the shape of a plate inclined upward toward the downstream side in the transporting direction of the sheet S. The tray body 2 is configured so that the top surface thereof is capable of receiving sheets S ejected from the edge-binding transport path SH15 by exit rollers Rh2, which are examples of ejecting members.

In FIG. 2, an end guide 3, which is an example of an aligning portion, is supported at the left end of the tray body 2. The end guide 3 extends in a direction toward the upper left that is perpendicular to the top surface of the tray body 2.

A pair of front and back tampers 4, which are examples of aligning members, are arranged on the tray body 2. The tampers 4 are supported so as to be movable toward and away from each other. The tampers 4 have the shape of a plate that extends in a direction toward the upper right that crosses the top surface of the tray body 2. Accordingly, the tampers 4 are capable of aligning the front and back edges of the sheets S stacked on the top surface of the tray body 2 by moving in the front-back direction.

First paddle wheels 6, which are examples of drawing members, are disposed in an upper left region of the tray body 2. The first paddle wheels 6 are arranged at intervals in the front-back direction.

The first paddle wheels 6 according to the first exemplary embodiment receive a driving force from a motor (not shown), which is an example of a drive source, through a rotating shaft 7. The first paddle wheels 6 rotate in such a direction that the sheets S on the compiler tray 1 are transported toward the end guide 3.

Ejecting rollers 11, which are examples of ejecting members, are disposed at the right end of the tray body 2. The ejecting rollers 11 are arranged at intervals in the front-back direction. The ejecting rollers 11 are supported such that the ejecting rollers 11 are rotatable around a rotating shaft 12 that extends in the front-back direction. The rotating shaft 12 receives a driving force for forward or reverse rotation from a motor (not shown), which is an example of a drive source.

Shelves 13, which are examples of extending members, are disposed near the rotating shaft 12. Each of the shelves 13 according to the first exemplary embodiment is supported so as to be movable between a retracted position illustrated in FIG. 2 and an extended position (not shown) at which the shelf 13 extends continuously from the tray body 2. The shelves 13 are arranged at intervals in the front-back direction, and are disposed between the ejecting rollers 11 in the front-back direction.

Setting clamps 14, which are examples of pressing members, are rotatably supported by the rotating shaft 12. The setting clamps 14 according to the first exemplary embodiment are arranged at intervals in the front-back direction. The setting clamps 14 are disposed between the ejecting rollers 11 and the shelves 13 in the front-back direction. Each setting clamp 14 is supported so as to be movable between a pressing position at which the setting clamp 14 comes into contact with and presses the top surface of the stack of sheets S ejected onto the stacker tray TH1 and a separated position at which the setting clamp 14 is separated from the sheets S. A solenoid (not shown), which is an example of a drive source, and a spring (not shown) are provided to enable each setting clamp 14 to move between the pressing position and the separated position. Each setting clamp 14 may instead be moved by driving the rotating shaft 12 in the forward or reverse direction by using, for example, a clutch, which is an example of a driving-force transmission switching member, in place of the solenoid.

Clamp rollers 21, which are examples of clamping members, are disposed above the compiler tray 1. The clamp rollers 21 are arranged at intervals in the front-back direction so as to correspond to the ejecting rollers 11. The clamp rollers 21 are composed of driven rollers.

Each clamp roller 21 is rotatably supported by a first raising-lowering arm 22, which is an example of a raising-lowering member. The first raising-lowering arm 22 is supported such that the first raising-lowering arm 22 is rotatable around a rotation center 22*a* at the left end thereof. The first raising-lowering arm 22 is movable by a solenoid (not shown), which is an example of a drive source, and a spring (not shown) between an upper position shown by the solid line in FIG. 2 and a lower position shown by the dashed line in FIG. 2. At the upper position, the clamp roller 21 is separated from the corresponding ejecting roller 11. At the lower position, the clamp roller 21 is in contact with the corresponding ejecting roller 11, or the sheets S are clamped between the clamp roller 21 and the ejecting roller 11.

An ordinary stapler 28, which is an example of a staple binding device, is disposed on the left side of the end guide 3. The ordinary stapler 28 is movable along a guide rail 29, which is an example of a guiding member that extends in the front-back direction, to a position at which the sheets S are to be bound together. The ordinary stapler 28 is capable of binding the sheets S together with a staple. The ordinary stapler 28 may have various well-known structures, such as that described in Japanese Unexamined Patent Application Publication No. 2003-089462, and detailed description thereof is thus omitted.

Positional Relationship Between Compiler Tray and Staplers

Figure 3:
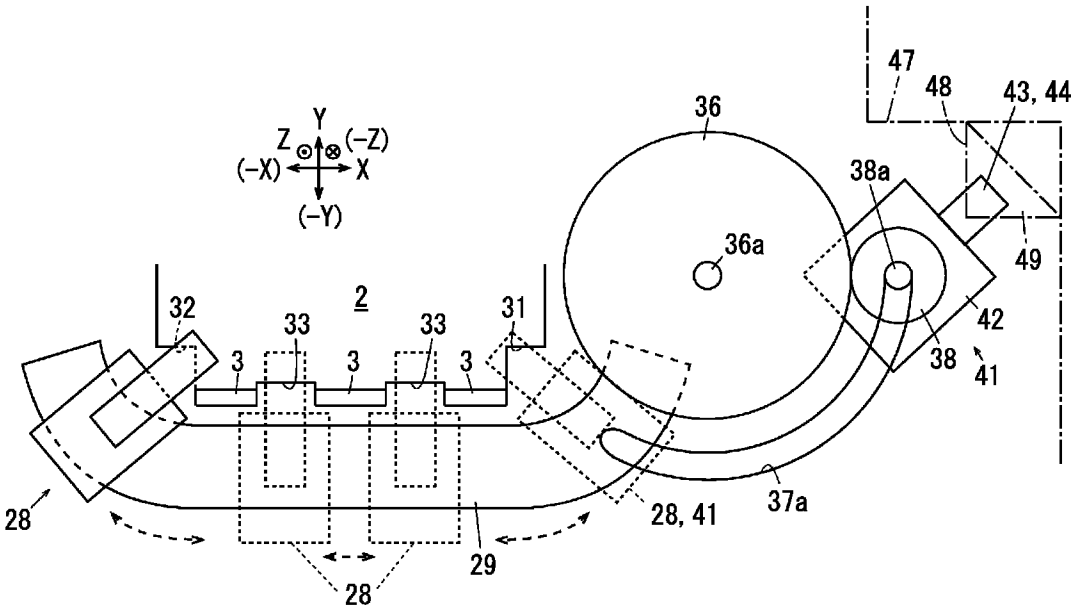
FIG. 3 illustrates an edge binding device according to the first exemplary embodiment.

FIG. 3 illustrates the edge binding device according to the first exemplary embodiment.

Referring to FIG. 3, the compiler tray 1 has corner recesses 31 and 32 for corner binding on the left side thereof at the corners in the width direction of the sheets S, that is, in the front-back direction. The compiler tray 1 also has plural side recesses 33 for side binding that are arranged in the width direction at intervals.

The guide rail 29 is disposed on the left side of the compiler tray 1 and extends along the left side surface of the compiler tray 1 so as to surround the front corner recess 31 and the back corner recess 32. Accordingly, the ordinary stapler 28 according to the first exemplary embodiment is movable to a back corner binding position, which corresponds to the back corner recess 32, side binding positions, which correspond to the side recesses 33, and a front corner binding position, which corresponds to the front corner recess 31. These positions are examples of staple binding positions. In the first exemplary embodiment, when the ordinary stapler 28 runs out of staples, the ordinary stapler 28 is supplied with staples at the front corner binding position. In other words, in the first exemplary embodiment, the front corner binding position serves as both a staple binding position and a supply position. In the first exemplary embodiment, the back corner binding position serves also as a retracted position of the ordinary stapler 28.

Figure 4:
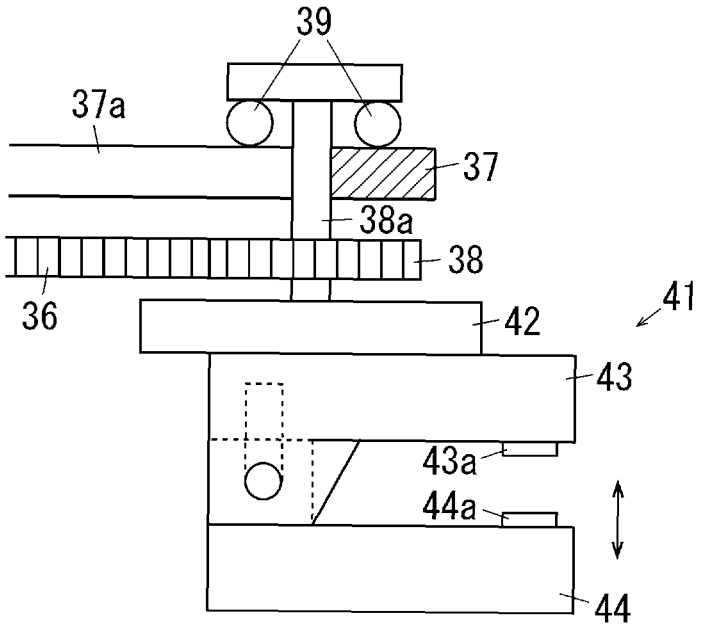
FIG. 4 illustrates a stapleless binding device according to the first exemplary embodiment.

FIG. 4 illustrates a stapleless binding device according to the first exemplary embodiment.

Referring to FIG. 3, a sun gear 36, which is an example of a first gear, is disposed in front of and above the compiler tray 1. A driving force is transmitted to a rotation center 36*a* of the sun gear 36 from a motor (not shown), which is an example of a drive source. Referring to FIGS. 3 and 4, a frame 37, which is an example of a frame member, is supported above the sun gear 36. The frame member 37 has a guide groove 37*a*, which is an example of a guide portion. The guide groove 37*a* is arc-shaped and is centered on the rotation center of the sun gear 36. Referring to FIGS. 3 and 4, the sun gear 36 meshes with a planet gear 38, which is an example of a second gear. The planet gear 38 is supported in such a manner that a rotating shaft 38*a* thereof extends through the guide groove 37*a*. Rollers 39 that roll along the upper surface of the frame 37 are supported around an upper portion of the rotating shaft 38*a*.

A stapleless stapler 41, which is an example of a stapleless binding device, is supported by a lower portion of the rotating shaft 38*a*. The stapleless stapler 41 includes a movable plate 42, which is an example of a movable frame member, in an upper section thereof. The movable plate 42 is fixed to the bottom end of the rotating shaft 38*a*. A stapleless-stapler fixed unit 43 is attached to the bottom surface of the movable plate 42. A stapleless-stapler movable unit 44, which is movable toward and away from the stapleless-stapler fixed unit 43, is attached to the stapleless-stapler fixed unit 43. The stapleless-stapler movable unit 44 is configured to be movable toward and away from the stapleless-stapler fixed unit 43 by a drive source, such a motor (not shown). The stapleless-stapler fixed unit 43 and the stapleless-stapler movable unit 44 respectively include binding portions 43*a* and 44*a* at the ends thereof. The stapleless stapler 41 binds sheets S clamped between binding portions 43*a* and 44*a* together without using a staple. In the first exemplary embodiment, the stapleless stapler 41 may be a device that binds the sheets S together by deforming portions of the sheets S clamped between the stapleless-stapler fixed unit 43 and the stapleless-stapler movable unit 44. Examples of known stapleless staplers of this type bind the sheets S together by cutting portions of the sheets S and folding the cut portions, or by deforming the sheets S into a wavy shape in the thickness direction and crimping the sheets S together. However, the stapleless stapler 41 may have any other configuration.

Referring to FIG. 3, the stapleless stapler 41 according to the first exemplary embodiment is configured such that when the sun gear 36 rotates, the rotating shaft 38*a* of the planet gear 38 rotates along the guide groove 37*a*. Accordingly, the stapleless stapler 41 of the first exemplary embodiment is movable between an off-line position, which is an example of a retracted position shown by the solid lines in FIG. 3, and a stapleless binding position, which is shown by the dashed lines. According to the first exemplary embodiment, the stapleless binding position coincides with the front corner binding position of the ordinary stapler 28.

In the first exemplary embodiment, the stapleless stapler 41 rotates around the rotating shaft 38*a* as the sun gear 36 and the planet gear 38 rotate. The number of teeth, diameter, etc., of each of the gears 36 and 38 are set so that the binding portions 43*a* and 44*a* of the stapleless stapler 41 face forward and to the right at the off-line position, and backward and to the right at the stapleless binding position.

Figure 5:
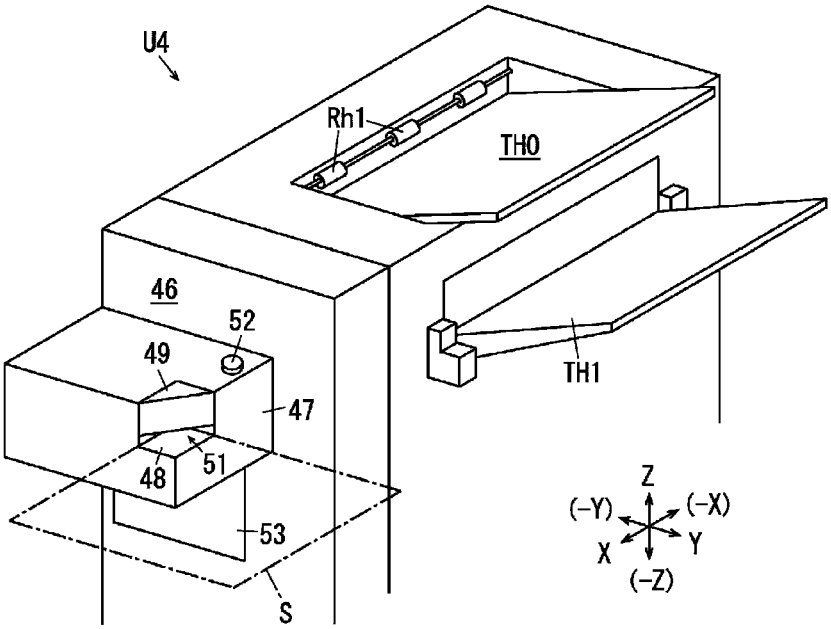
FIG. 5 is an external view of an upper section of the post-processing device according to the first exemplary embodiment.

FIG. 5 is an external view of an upper section of the post-processing device according to the first exemplary embodiment.

Referring to FIGS. 3 and 5, a manual binding unit 47 is disposed on a front surface 46 of the finisher U4 according to the first exemplary embodiment. The manual binding unit 47 is box-shaped and projects forward from the front surface 46 of the finisher U4. When the stapleless stapler 41 is moved to the off-line position, the stapleless stapler 41 is disposed in the manual binding unit 47.

A recess 48 that is recessed inward is formed in a front right section of the manual binding unit 47. When the stapleless stapler 41 is moved to the off-line position, the binding portions 43*a* and 44*a* of the stapleless stapler 41 are disposed at the back of the recess 48, that is, in a deep section of the recess 48. A window 49 is disposed above the recess 48. In the first exemplary embodiment, the window 49 is made of a transparent material. Therefore, an end portion of the stapleless stapler 41 is visually recognizable from the outside through the window 49. A slit 51, which is an example of a passage, is formed between the bottom end of the window 49 and the recess 48. Therefore, a corner of the stack of sheets S may be inserted into the gap between the binding portions 43*a* and 44*a* of the stapleless stapler 41 through the slit 51.

In FIG. 5, an off-line binding button 52, which is an example of an input member, is disposed on the top surface of the manual binding unit 47. When the off-line binding button 52 is operated, the stapleless stapler 41 is activated, and stapleless binding of the stack of sheets S inserted in the slit 51 is performed.

An opening-closing cover 53 that is capable of being opened and closed is disposed below the manual binding unit 47. The opening-closing cover 53 is opened to enable supplying of staples to the ordinary stapler 28 at the front corner binding position through the front surface.

Description of Controller of First Exemplary Embodiment

Figure 6:
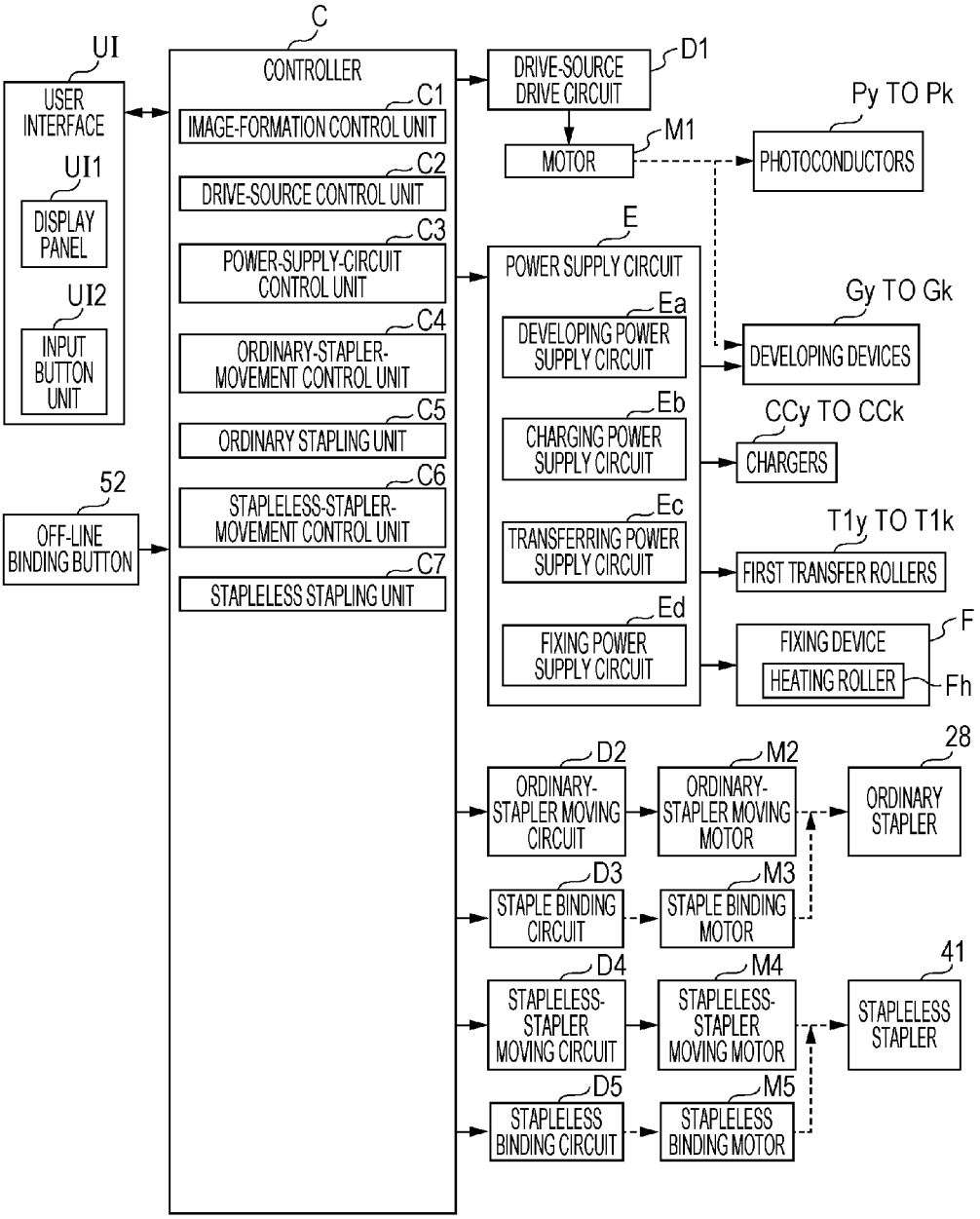
FIG. 6 is a block diagram illustrating functions of a controller included in the image forming apparatus according to the first exemplary embodiment.

FIG. 6 is a block diagram illustrating functions of the controller included in the image forming apparatus according to the first exemplary embodiment.

Referring to FIG. 6, the controller C of the copy machine U includes an input/output interface I/O that transmits and receives signals to and from an external device. The controller C also includes a read only memory (ROM) that stores programs, information, etc., necessary to perform required processes. The controller C also includes a random access memory (RAM) that temporarily stores necessary data. The controller C also includes a central processing unit (CPU) that carries out processes based on the programs stored in, for example, the ROM. Accordingly, the controller C of the first exemplary embodiment is constituted by a microcomputer, which is a small information processing device. The controller C provides various functions by executing the programs stored in, for example, the ROM.

Signal-Outputting Elements Connected to Controller C

The controller C receives output signals from signal-outputting elements including the user interface UI and the off-line binding button 52.

The user interface UI includes the display panel UI1 and the input button unit UI2 including a copy start key, numeric keys, and a copy-number input key.

The off-line binding button 52 transmits a signal to the controller C when operated by a user.

Controlled Elements Connected to Controller C

The controller C is connected to a drive-source drive circuit D1, an ordinary-stapler moving circuit D2, a staple binding circuit D3, a stapleless-stapler moving circuit D4, a stapleless binding circuit D5, a power supply circuit E, and other controlled elements that are not illustrated. The controller C outputs control signals to the circuits D1 to D5 and E and other elements.

D1: Drive-Source Drive Circuit

The drive-source drive circuit D1 rotates, for example, the photoconductors PRy to PRk and the intermediate transfer belt B by using a motor M1, which is an example of a drive source.

D2: Ordinary-Stapler Moving Circuit

The ordinary-stapler moving circuit D2 moves the ordinary stapler 28 between the binding positions by using an ordinary-stapler moving motor M2.

D3: Staple Binding Circuit

The staple binding circuit D3 activates the ordinary stapler 28 by using a staple binding motor M3 to bind the sheets S together with a staple.

D4: Stapleless-Stapler Moving Circuit

The stapleless-stapler moving circuit D4 moves the stapleless stapler 41 between the above-described positions by using a stapleless-stapler moving motor M4.

D5: Stapleless Binding Circuit

The stapleless binding circuit D5 activates the stapleless stapler 41 by using a stapleless binding motor M5 to bind the sheets S together without using a staple.

E: Power Supply Circuit

The power supply circuit E includes a developing power supply circuit Ea, a charging power supply circuit Eb, a transferring power supply circuit Ec, and a fixing power supply circuit Ed.

Ea: Developing Power Supply Circuit

The developing power supply circuit Ea applies a developing voltage to the developing roller of each of the developing devices Gy to Gk.

Eb: Charging Power Supply Circuit

The charging power supply circuit Eb applies a charging voltage for charging the surface of each of the photoconductors Py to Pk to each of the chargers CCy to CCk.

Ec: Transferring Power Supply Circuit

The transferring power supply circuit Ec applies a transfer voltage to the first transfer rollers T1*y* to T1*k* and the backup roller T2*a*.

Ed: Fixing Power Supply Circuit

The fixing power supply circuit Ed supplies electric power to the heater of the heating roller Fh included in the fixing device F.

Functions of Controller C

The controller C has a function of executing processes corresponding to the signals input from the signal-outputting elements and outputting control signals to the controlled elements. Namely, the controller C functions as the following units.

C1: Image-Formation Control Unit

An image-formation control unit C1 performs a job, that is, an image forming operation, by controlling the driving state, voltage application time, etc., of each of the components of the scanner unit U1 and the printer unit U3 in accordance with an input through the user interface UI or an input of image information from, for example, an external personal computer.

C2: Drive-Source Control Unit

A drive-source control unit C2 controls the driving states of the components including the photoconductors Py to Pk by controlling the driving state of the motor M1 via the drive-source drive circuit D1.

C3: Power-Supply-Circuit Control Unit

A power-supply-circuit control unit C3 controls the voltage applied to each component and the electric power supplied to each component by controlling the power supply circuits Ea to Ed.

C4: Ordinary-Stapler-Movement Control Unit

An ordinary-stapler-movement control unit C4 controls the movement of the ordinary stapler 28 via the ordinary-stapler moving circuit D2. When staple binding is selected in the job, the ordinary-stapler-movement control unit C4 of the first exemplary embodiment moves the ordinary stapler 28 in accordance with the setting of the binding position, that is, in accordance with the setting of corner binding or side binding. When stapleless binding is selected, the ordinary-stapler-movement control unit C4 of the first exemplary embodiment moves the ordinary stapler 28 to the retracted position, that is, to the back corner binding position.

C5: Ordinary Stapling Unit

An ordinary stapling unit C5 controls the ordinary stapler 28 via the staple binding circuit D3. When staple binding is selected, the ordinary stapler 28 is moved to the binding position. Then, the ordinary stapling unit C5 of the first exemplary embodiment activates the ordinary stapler 28 to bind the sheets S together with a staple.

C6: Stapleless-Stapler-Movement Control Unit

A stapleless-stapler-movement control unit C6 controls the movement of the stapleless stapler 41 via the stapleless-stapler moving circuit D4. When stapleless binding is selected in the job, the stapleless-stapler-movement control unit C6 of the first exemplary embodiment moves the stapleless stapler 41 to the stapleless binding position. In the first exemplary embodiment, the stapleless stapler 41 is moved to the off-line position when the job is completed. When staple binding is selected, the stapleless-stapler-movement control unit C6 of the first exemplary embodiment moves the stapleless stapler 41 to the retracted position, that is, to the off-line position at which the stapleless stapler 41 does not interfere with the ordinary stapler 28 at the front corner binding position.

C7: Stapleless Stapling Unit

A stapleless stapling unit C7 controls the stapleless stapler 41 via the stapleless binding circuit D5. When stapleless binding is selected in the job, the stapleless stapler 41 is moved to the stapleless binding position. Then, when a predetermined number of sheets S are stacked, the stapleless stapling unit C7 of the first exemplary embodiment activates the stapleless stapler 41 to bind the sheets S together without using a staple. In addition, when the off-line binding button 52 is operated, the stapleless stapling unit C7 of the first exemplary embodiment activates the stapleless stapler 41 at the off-line position to bind the sheets S together without using a staple.

Description of Flowchart of First Exemplary Embodiment

The control sequence of the finisher U4 included in the copy machine U of the first exemplary embodiment will now be described with reference to a flowchart.

Description of Flowchart of Stapling Process

Figure 7:
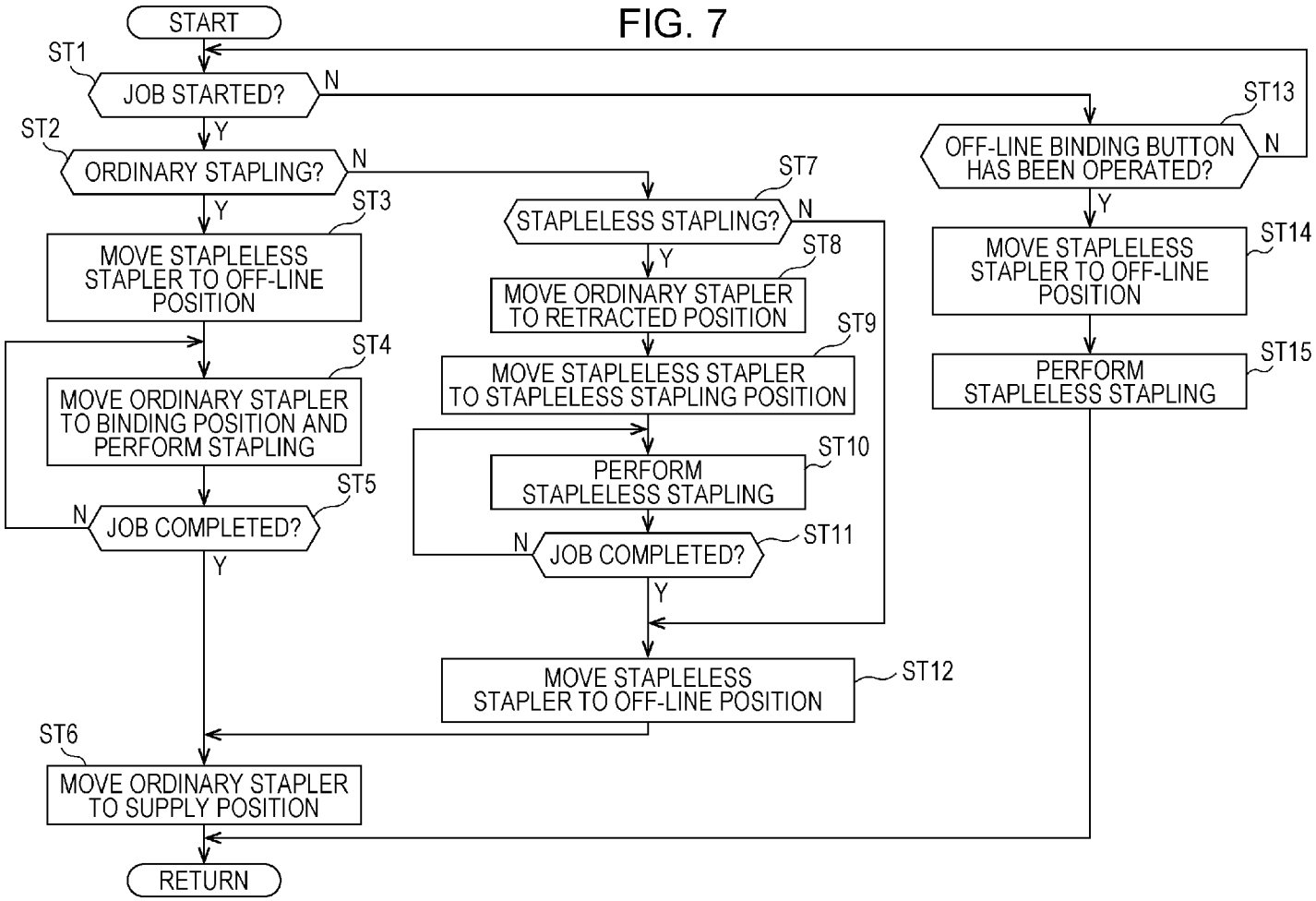
FIG. 7 is a flowchart of a stapling process according to the first exemplary embodiment.

FIG. 7 is a flowchart of a stapling process according to the first exemplary embodiment.

Each of the processes in steps ST of the flowchart of FIG. 7 is carried out in accordance with a program stored in the controller C of the copy machine U. The processes are executed in parallel to other processes performed by the copy machine U.

The flowchart of FIG. 7 is started when the power of the copy machine U is turned on.

In ST1 of FIG. 7, it is determined whether a job has been started. If yes (Y), the process proceeds to ST2. If no (N), the process proceeds to ST13.

In ST2, it is determined whether or not ordinary stapling is set. If yes (Y), the process proceeds to ST3. If no (N), the process proceeds to ST7.

In ST3, the stapleless stapler 41 is moved to the off-line position. When the stapleless stapler 41 is already at the off-line position, the position thereof is maintained at the off-line position (the same applies hereinafter). Then, the process proceeds to ST4.

In ST4, the ordinary stapler 28 is moved to a binding position, and ordinary stapling is performed when a predetermined number of sheets S are stacked on the compiler tray 1. Then, the process proceeds to ST5.

In ST5, it is determined whether or not the job is completed. If yes (Y), the process proceeds to ST6. If no (N), the process returns to ST4.

In ST6, the ordinary stapler 28 is moved to the supply position, that is, to the front corner binding position. Then, the process returns to ST1.

In ST7, it is determined whether or not stapleless stapling is set. If yes (Y), the process proceeds to ST8. If no (N), that is, if no stapling process is set, the process proceeds to ST12.

In ST8, the ordinary stapler 28 is moved to the retracted position, that is, to the back corner binding position. Then, the process proceeds to ST9.

In ST9, the stapleless stapler 41 is moved to the stapleless binding position. Then, the process proceeds to ST10.

In ST10, stapleless stapling is performed when a predetermined number of sheets S are stacked on the compiler tray 1. Then, the process proceeds to ST11.

In ST11, it is determined whether or not the job is completed. If yes (Y), the process proceeds to ST12. If no (N), the process returns to ST10.

In ST12, the stapleless stapler 41 is moved to the off-line position. Then, the process proceeds to ST6.

In ST13, it is determined whether or not the off-line binding button 52 has been operated. If yes (Y), the process proceeds to ST14. If no (N), the process returns to ST1.

In ST14, the stapleless stapler 41 is moved to the off-line position. Then, the process proceeds to ST15.

In ST15, the stapleless stapler 41 is activated to perform stapleless stapling. Then, the process returns to ST1.

Description of Functions of Edge Binding Device

In the edge binding device HTS according to the first exemplary embodiment having the above-described structure, the sheets S are ejected to the compiler tray 1 when the settings are such that edge binding or set ejection, which is an operation of aligning the sheets S and ejecting the aligned sheets S without binding the sheets S together, is to be performed. The sheets S ejected onto the compiler tray 1 are drawn toward the end guide 3. The sheets S are caused to abut against the end guide 3, so that the sheets S are aligned in the transporting direction of the sheets S. When the sheets S are stacked on the compiler tray 1, the tampers 4 are activated to align the sheets S in the width direction thereof.

In the case where the settings are such that set ejection is to be performed, when a single set of sheets S is placed on the compiler tray 1, the clamp rollers 21 move downward so that the sheets S are clamped between the ejecting rollers 11 and the clamp rollers 21. Then, the ejecting rollers 11 are activated so that the set of sheets S is ejected to the stacker tray TH1.

In the case where the settings are such that staple edge binding is to be performed, when a single set of sheets S is placed on the compiler tray 1, the ordinary stapler 28 is activated so that the sheets S are bound together with a staple at a set binding position. Similarly to the case in which set ejection is performed, the stack of bound sheets S is clamped between the clamp rollers 21 and the ejecting rollers 11 and ejected onto the stacker tray TH1.

In the case where the settings are such that stapleless edge binding is to be performed, when a single set of sheets S is placed on the compiler tray 1, the stapleless stapler 41 is activated so that the sheets S are bound together without using a staple. Similarly to the case in which set ejection is performed, the stack of bound sheets S is clamped between the clamp rollers 21 and the ejecting rollers 11 and ejected onto the stacker tray TH1.

Each time a stack of sheets S is ejected onto the stacker tray TH1, the setting clamp 14 comes into contact with the uppermost surface of the stack of sheets S to prevent the stack of sheets S ejected next from interfering with the stacks of sheets S that have already been ejected.

In the finisher U4 of the first exemplary embodiment, the stapleless stapler 41 is disposed in front of the ordinary stapler 28. When the stapleless stapler is disposed in an inner section as in the related art, the stapleless stapler cannot be easily replaced or repaired in the event of breakage. In the structure of the related art, since the ordinary stapler needs to be periodically refilled with staples, the ordinary stapler, which requires refilling, is disposed in a front section and the stapleless stapler is disposed in a back section.

In contrast, in the first exemplary embodiment, the stapleless stapler 41 is disposed in the front section of the finisher U4, so that the stapleless stapler 41 may be easily replaced or repaired in the event of breakage or maintenance. In addition, the ordinary stapler 28 may be refilled with staples and accessed in the event of breakage by opening the opening-closing cover 53 on the front surface. The stapleless stapler 41 is also movable to the supply position. When the stapleless stapler 41 is moved to the supply position, the stapleless stapler 41 may also be accessed for maintenance by opening the opening-closing cover 53.

In addition, in the first exemplary embodiment, when the off-line binding button 52 is operated while the stapleless stapler 41 is at the off-line position, the stapleless stapler 41 performs stapleless binding. While ordinary staplers are a commonly used stationery or office supply product and may be found in the office in which the copy machine U is installed, stapleless staplers are not as common as ordinary staplers. In the structure described in Japanese Unexamined Patent Application Publication No. 2015-030592, manual stapling may be performed by using an ordinary stapler included in a finisher. However, staple binding may also be achieved by using an ordinary stapler that is commonly used as an office supply product, and the need therefor is not particularly strong. In contrast, stapleless staplers are not commonly used, and there is a stronger need for stapleless binding than for staple binding. Accordingly, in the first exemplary embodiment, stapleless binding is performed when the off-line binding button 52 is operated. Thus, the need for stapleless binding may be satisfied.

In addition, in the first exemplary embodiment, the transparent window 49 is provided at the off-line position. The transparent window 49 allows the user to check the position of the stack of sheets S when stapleless binding is performed. In addition, in the first exemplary embodiment, stapleless binding is performed on the stack of sheets S that is inserted into the slit 51 between the window 49 and the recess 48. Therefore, the user is prevented from accidentally inserting their fingers into the end portion of the stapleless stapler 41.

In addition, in the first exemplary embodiment, stapleless binding is performed when the off-line binding button 52 is operated. Therefore, the user may carry out stapleless binding more easily than in the case where stapleless binding is performed manually. Stapleless binding generally requires a larger force than staple binding when performed manually. Therefore, in the first exemplary embodiment, the user may easily carry out stapleless binding by operating the off-line binding button 52.

In addition, in the first exemplary embodiment, the orientation of the stapleless stapler 41 is changed when the stapleless stapler 41 is moved between the off-line position and the stapleless binding position by the sun gear 36 and the planet gear 38. Therefore, the overall structure is simpler than that in the case where a structure for changing the orientation of the stapleless stapler 41 and a structure for moving the stapleless stapler 41 are provided individually.

Second Exemplary Embodiment

A second exemplary embodiment of the present invention will now be described. In the second exemplary embodiment, components corresponding to the components of the first exemplary embodiment are denoted by the same reference symbols, and detailed description thereof is omitted.

The present exemplary embodiment differs from the first exemplary embodiment in the points described below, but is otherwise similar to the first exemplary embodiment.

Figure 8A:
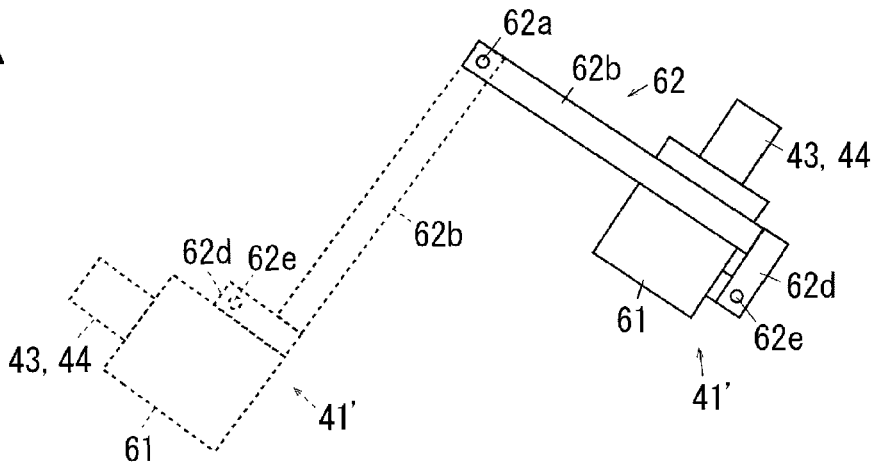
FIGS. 8A to 8C illustrate a stapleless stapler according to a second exemplary embodiment, where FIG. 8A corresponds to FIG. 3 of the first exemplary embodiment and illustrates a movement between a retracted position and a stapleless binding position.
Figure 8B:
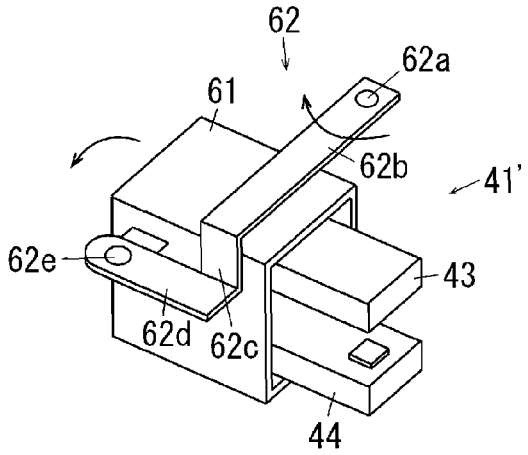
Figure 8C:
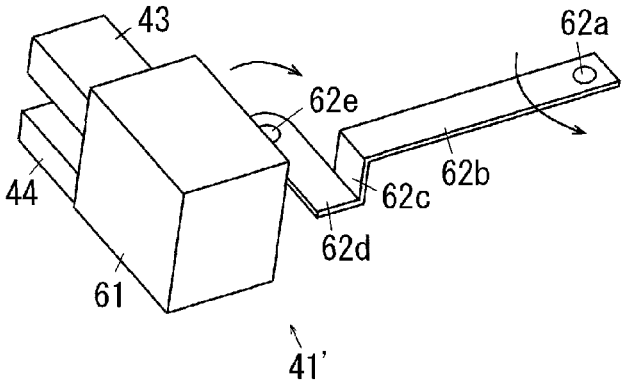

FIGS. 8A to 8C illustrate a stapleless stapler according to a second exemplary embodiment. FIG. 8A corresponds to FIG. 3 of the first exemplary embodiment and illustrates a movement between a retracted position and a stapleless binding position. FIG. 8B is a perspective view of the stapleless stapler at the retracted position. FIG. 8C is a perspective view of the stapleless stapler at the stapleless binding position.

Referring to FIGS. 8A to 8C, a finisher U4 of the second exemplary embodiment does not include the sun gear 36, the guide groove 37*a*, or the planet gear 38. A stapleless stapler 41' according to the second exemplary embodiment includes a stapleless-stapler fixed unit 43 and a stapleless-stapler movable unit 44 disposed in a box-shaped casing 61. A link 62, which is an example of a support, is attached to a side surface of the casing 61. The link 62 is rotatably supported by a rotating shaft 62*a* in the finisher U4. A driving force is transmitted to the rotating shaft 62*a* from a drive source (not shown). The link 62 includes a first arm 62*b* that extends from the rotating shaft 62*a*. A second arm 62*c* that extends downward is connected to a distal end of the first arm 62*b*. A third arm 62*d* that extends in a direction that crosses the first arm 62*b* in top view is connected to the bottom end of the second arm 62*c*. The casing 61 is rotatably attached to an end 62*e* of the third arm 62*d*.

Operation of Second Exemplary Embodiment

When the stapleless stapler 41' according to the second exemplary embodiment having the above-described structure is to be moved from the off-line position to the stapleless binding position, the rotating shaft 62*a* is rotated clockwise in FIG. 8A. At this time, a side surface of the third arm 62*d* comes into contact with a side surface of the casing 61 so that the casing 61 rotates around the end 62*e*. The rotation of the casing 61 stops when the other side surface of the third arm 62*d* comes into contact with the casing 61. Thus, the stapleless stapler 41' moves to the stapleless binding position as shown by the dashed lines in FIG. 8A, and as shown in FIG. 8C. When the rotating shaft 62*a* is rotated in the opposite direction, the above-described process is performed in the reverse manner so that the stapleless stapler 41' moves to the off-line position.

Similar to the first exemplary embodiment, the stapleless stapler 41' of the second exemplary embodiment may also be moved between the off-line position and the stapleless binding position by a simple structure.

Third Exemplary Embodiment

A third exemplary embodiment of the present invention will now be described. In the third exemplary embodiment, components corresponding to the components of the first exemplary embodiment are denoted by the same reference symbols, and detailed description thereof is omitted.

The present exemplary embodiment differs from the first exemplary embodiment in the points described below, but is otherwise similar to the first exemplary embodiment.

Figure 9A:
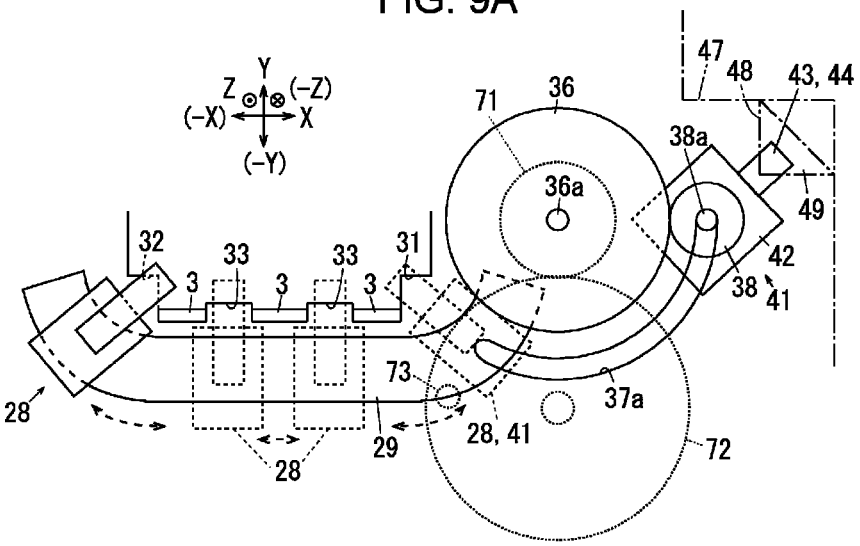
FIGS. 9A and 9B illustrate an edge binding device according to a third exemplary embodiment, where FIG. 9A corresponds to FIG. 3 of the first exemplary embodiment, and FIG. 9B corresponds to FIG. 4 of the first exemplary embodiment.
Figure 9B:
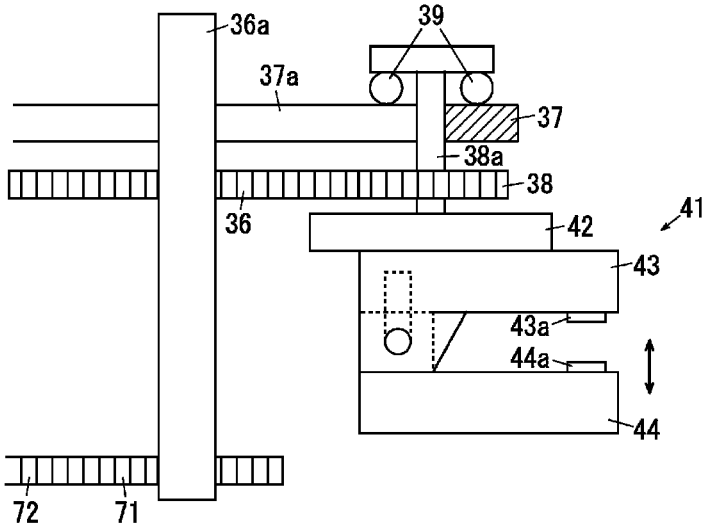

FIGS. 9A and 9B illustrate an edge binding device according to the third exemplary embodiment. FIG. 9A corresponds to FIG. 3 of the first exemplary embodiment, and FIG. 9B corresponds to FIG. 4 of the first exemplary embodiment.

Referring to FIGS. 9A and 9B, in an edge binding device HTS according to the third exemplary embodiment, a first transmission gear 71, which is an example of a driving-force transmitting member, is attached to the bottom end of the rotation center 36*a*. Therefore, when a rotating force is transmitted to the first transmission gear 71, the rotation center 36*a* is rotated so as to move the stapleless stapler 41. A second transmission gear 72, which is also an example of a driving-force transmitting member, meshes with the first transmission gear 71. A pin 73, which is an example of a contact member, is attached to an outer peripheral portion of the second transmission gear 72. The pin 73 is capable of coming into contact with a cart of the ordinary stapler 28.

In the third exemplary embodiment, when the stapleless stapler 41 is moved to the stapleless binding position, the pin 73 is moved to the position illustrated in FIG. 9A. Also, the diameters and numbers of teeth of the transmission gears 71 and 72 are set so that when the ordinary stapler 28 is moved to the front corner binding position, the pin 73 is pushed by the ordinary stapler 28 and the transmission gears 71 and 72 are rotated so that the stapleless stapler 41 is moved to the off-line position.

Operation of Third Exemplary Embodiment

In the edge binding device HTS according to the third exemplary embodiment having the above-described structure, when the ordinary stapler 28 is moved toward the front corner binding position (staple supply position) from the retracted position or a side binding position while the stapleless stapler 41 is at the stapleless binding position, the ordinary stapler 28 comes into contact with the pin 73 before the ordinary stapler 28 reaches the front corner binding position. Then, as the ordinary stapler 28 moves toward the front corner binding position, the pin 73 is pushed and the transmission gears 71 and 72 are rotated so that the stapleless stapler 41 moves toward the off-line position. Accordingly, in the third exemplary embodiment, even when the stapleless stapler 41 is at the stapleless binding position when the ordinary stapler 28 moves toward the front corner binding position, the stapleless stapler 41 is pushed to the off-line position. When the ordinary stapler 28 is at the front corner binding position when the stapleless stapler 41 moves from the off-line position toward the stapleless binding position, the pin 73 pushes the cart of the ordinary stapler 28 and moves the ordinary stapler 28 backward. Therefore, the ordinary stapler 28 and the stapleless stapler 41 are prevented from interfering with each other.

Modifications

Although exemplary embodiments of the present invention have been described in detail, the present invention is not limited to the exemplary embodiments, and various modifications are possible within the scope of the present invention described in the claims. Exemplary modifications (H01) to (H08) of the present invention will be described.

(H01) In the exemplary embodiments, the copy machine U is described as an example of an image forming apparatus. However, the present invention is not limited to this, and is also applicable to any structure including a post-processing device, such as a printer, a facsimile machine, or a multifunction machine having the functions of these machines.

(H02) In the exemplary embodiments, it is not necessary that the post-processing device include the top tray TH0 and the saddle stitching device NTS.

(H03) In the exemplary embodiments, the supply position of the ordinary stapler 28 serves also as the front corner binding position. However, the present invention is not limited to this. For example, the supply position may instead be set to a position in front of or to the right of the front corner binding position.

(H04) In the exemplary embodiments, the retracted position of the stapleless stapler 41, 41' coincides with the off-line position. However, the present invention is not limited to this. For example, the retracted position may instead be set between a side binding position and the off-line position.

(H05) In the exemplary embodiments, stapleless binding is performed when the off-line binding button 52 is operated. However, the present invention is not limited to this. For example, the stapleless stapler 41 may instead be configured so that the end portion thereof may be exposed to allow manual operation by the user. Although a structure that allows a stack of sheets S to be inserted from the outside of the finisher U4 and subjected to stapleless binding may be provided, this structure may be omitted.

(H06) Although the transparent window 49 may be provided as in the exemplary embodiments, the transparent window 49 may be omitted.

(H07) In the exemplary embodiments, the gears 36 and 38 and the link 62 are described as the components for moving the stapleless stapler 41, 41'. However, the present invention is not limited to this, and a structure similar to the guide rail 29 or a slider, for example, may be used instead. In the first exemplary embodiment, the relationships between the sizes and vertical positions of the gears 36 and 38 and the guide rail 29 are not limited to those described above, and may be changed as appropriate.

(H08) In the exemplary embodiments, the ordinary stapler 28 and the stapleless stapler 41, 41' are controlled by the controller C, or physically pushed by the transmission gears 71 and 72 and the pin 73, so as not to interfere with each other. However, the present invention is not limited to this. For example, the ordinary stapler 28 and the stapleless stapler 41, 41' may be provided with link members that extend toward each other so that the stapleless stapler 41, 41' at the stapleless binding position is pushed toward the off-line position when the ordinary stapler 28 moves toward the supply position, and so that the ordinary stapler 28 at the supply position is pushed when the stapleless stapler 41, 41' moves to the stapleless binding position.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a stacking portion on which media having images recorded thereon are stacked;

a staple binding device that binds the media stacked on the stacking portion together by using a staple and that is movable between a plurality of staple binding positions at which the staple binding device binds the media together and a supply position that is in a front section in a width direction of the media and at which staples are suppliable to the staple binding device; and a stapleless binding device that binds the media stacked on the stacking portion together without using a staple and that is movable between a stapleless binding position at which the stapleless binding device binds the media together and a retracted position that is in the front section in the width direction of the media, wherein, when the stapleless binding device is moved to the retracted position, the staple binding device and the stapleless binding device do not interfere with each other irrespective of a position of the staple binding device.

2. The post-processing device according to claim 1, wherein the stapleless binding position, at which the stapleless binding device binds the media together without using a staple, is at or behind the supply position of the staple binding device, which binds the media together by using a staple, in the width direction of the media.

3. The post-processing device according to claim 1, wherein one of the staple binding positions that is foremost in the width direction of the media coincides with the stapleless binding position, at which the stapleless binding device binds the media together without using a staple.

4. The post-processing device according to claim 1, wherein the stapleless binding device is capable of performing stapleless binding on media inserted from outside of the post-processing device at the retracted position.

5. The post-processing device according to claim 4, further comprising:

an input member used to perform stapleless binding at the retracted position.

6. The post-processing device according to claim 4, further comprising:

a window through which the stapleless binding device moved to the retracted position is externally visible.

7. The post-processing device according to claim 1, wherein the stapleless binding device rotates around a rotation center to move between the stapleless binding position and the retracted position.

8. The post-processing device according to claim 7, further comprising:

a first gear supported by a body of the post-processing device; and a second gear that meshes with the first gear and that is supported by the stapleless binding device, the second gear moving the stapleless binding device between the stapleless binding position and the retracted position as the first gear rotates.

9. The post-processing device according to claim 7, further comprising:

a support that supports the stapleless binding device so that the stapleless binding device is rotatable, that is supported by a body of the post-processing device so as to be rotatable around the rotation center, and that moves the stapleless binding device between the stapleless binding position and the retracted position.

10. The post-processing device according to claim 1, wherein when the staple binding device moves to the supply position, the stapleless binding device moves to the retracted position in response to a movement of the staple binding device.

11. An image forming apparatus comprising:

an image forming apparatus body that forms images on media; and the post-processing device according to claim 1 that performs post-processing on the media transported from the image recording apparatus body.

* * * * *